United States Patent [19]

Zollinger et al.

[11] Patent Number: 4,852,618

[45] Date of Patent: Aug. 1, 1989

[54] WEFT YARN SELECTOR FOR A LOOM

[75] Inventors: Hans Zollinger; Fredi Oderbolz, both of Tann-Ruti, Switzerland

[73] Assignee: Sulzer Brothers Limited, Winterthur, Switzerland

[21] Appl. No.: 175,048

[22] Filed: Mar. 30, 1988

[30] Foreign Application Priority Data

Apr. 3, 1987 [CH] Switzerland ..... 1285/87

[51] Int. Cl.[4] ..... D03D 47/38

[52] U.S. Cl. ..... 139/453

[58] Field of Search ..... 139/450, 452, 453

[56] References Cited

U.S. PATENT DOCUMENTS

| | | | |
|---|---|---|---|
| 3,782,421 | 1/1974 | Budzyna . | |
| 4,191,222 | 3/1980 | Marshall | 139/453 |
| 4,298,034 | 11/1981 | Viscardi | 139/453 |
| 4,556,089 | 12/1985 | Juillard | 139/453 |

FOREIGN PATENT DOCUMENTS

| | | |
|---|---|---|
| 2644648 | 4/1977 | Fed. Rep. of Germany . |
| 1440871 | 4/1966 | France . |
| 0978737 | 11/1982 | U.S.S.R. . |
| 2099863 | 12/1982 | United Kingdom . |

*Primary Examiner*—Henry S. Jaudon

*Attorney, Agent, or Firm*—Kenyon & Kenyon

[57] ABSTRACT

The yarn selector comprises a number of yarn regulators each adapted to be selectively adjusted by way of a driving member between a standby position and a transfer position in dependence upon an actuator in which transfer position, a weft yarn is presented to a picking element for a subsequent pick. The driving members are selectively engageable with and disengageable from a driver oscillated at the cadence of the picking fequency. Each driving member is adapted to be locked, with the actuator in an active state by way of a ever-arm in an operative position corresponding to the transfer position of the yarn regulator, and to be disengaged from the lever arm with the actuator in a passive state. The particular yarn regulator concerned remains, if the same weft yarn is required for the next pick, in the transfer position after yarn transfer and is returned to the standby position only before a weft yarn change.

20 Claims, 4 Drawing Sheets

WEFT YARN SELECTOR FOR A LOOM

The invention relates to a weft yarn selector for a loom. Heretofore, various types of weft yarn selectors have been known for the picking of weft yarns into a shed of warp yarns from a plurality of weft yarn packages disposed outside the shed. Usually, a number of yarn regulators have been employed to individually guide a weft yarn and each has been adapted to be selectively reciprocated between a standby position and a transfer position by way of a driving member. Each driving member, in turn, has been adapted to be engaged with and disengaged from a driver and oscillated at the cadence of the picking frequency by means of an associated actuator. The particular yarn concerned is usually presented in the transfer position to a picking element introducible into the shed for a subsequent pick.

In conventional selectors of this kind, after transfer of a yarn to the picking element, each yarn regulator is returned from the transfer position to the standby position and stands by therein for a further pick for which the weft yarn associated with the particular regulator concerned is to be presented to the picking element. In a selector of this kind known from German PS No. 3 214 800, the yarn regulators are each pivotally connected to a non-displaceably mounted swing arm engageable by way of a magnet armature thereon with an electromagnet disposed on a non-displaceably mounted driver support oscillating at the cadence of the picking frequency. The support can be pivoted by way of a cam drive between an inoperative position, corresponding to the standby position of the yarn regulators, and an operative position, corresponding to their transfer position, and has a transverse web carrying all the electromagnets associated with the swing arms. In accordance with the program controlling weft yarn selection, one of the swing arms is engaged by way of the associated energized electromagnet with the driver support and moved together with the associated yarn regulator from the standby position into the transfer position. After each pick, the yarn regulator is returned from the transfer position to the standby position even when the same weft yarn is to be used for the immediately following pick. Thus the corresponding yarn regulator must be moved again for such pick and for each further immediately following pick into the transfer position from the standby position it has just moved into. However, the unnecessary return and advance movements of the yarn regulator and the corresponding deflecting and feeding weft yarn movements cause unnecessary stressing of the co-operating elements of the selector and of the weft yarns. In particular, the operationally determined tension of the weft yarn being reciprocated between an extended position and a deflected position may be decreased disadvantageously.

German PS No. 2 644 648 discloses a weft yarn selector wherein a locking hook is connected to a control magnet and is associated with each yarn regulator and, with the magnet energized, retains one end of a driving lever pivotally connected to the regulator. However, the locking hook of this known selector merely determines the place of articulation of the driving lever in the pivoting of the regulator. In this arrangement, too, the driving levers selectively articulatable to the hook return the yarn regulators from the transfer position to the standby position after each yarn transfer. This known selector does not and indeed cannot provide a locking of the yarn regulators in the transfer position.

Accordingly, it is an object of the invention to provide a weft yarn selector which limits the number of adjusting movements of the yarn regulators and of the driving elements co-operating therewith to a minimum.

It is another object of the invention to reduce stressing of the co-operating elements of a weft yarn selector and to guide weft yarns more smoothly and less harshly than in previous constructions.

Briefly, the invention provides a weft yarn selector for a loom which includes a yarn regulator movable between a standby position and a transfer position, a driving member for moving the yarn regulator between these positions and which is provided with a step and a driver engageable against the step of the driving member to move the regulator from the standby position into the transfer position. In addition, the selector has a guide member for moving the driving member transversely of the driver to permit engagement of the driver with the step as well as an actuator which is operable between an active state and a passive state. The actuator which may be an electromagnet is connected with the guide member to move the guide member against the driving member in the active state to permit engagement of the driver with the step.

The driving member also has a second step to be engaged by the guide member when the actuator is in the active state in order to lock the regulator in the transfer position. Thus, after a pick, the regulator can be locked in the transfer position while the driver recycles a second pick of the same yarn. According to the invention, therefore, the driving member is engaged by way of a non-displaceably mounted guide member with the actuator active and is movable out of such path with the actuator passive. The guide member also functions as a locking element which is controllable by way of the actuator and is adjustable between a release position adapted to be occupied with the actuator passive and permitting relative movements of the driving member and a looking position adapted to be occupied with the actuator active.

The selector is so devised that whichever yarn regulator is in the transfer position and whichever driving members are co-operating therewith can be intermittently disengaged from the driver, which is driven automatically at the picking frequency cadence, if the actuator associated with the particular yarn regulator concerned—in accordance with the particular weft yarn selection program concerned—remains activated for picking the same weft yarn in the next weaving cycle. If a different weft yarn is required for picking in the next cycle, the locking element which has been moved into the release position, releases the driving member and the same returns to the normal or inoperative position corresponding to the standby position of the yarn regulator.

In one embodiment, the guide member is in the form of a two-armed lever to effect both the drive and the locking of the regulator. In this embodiment, the lever is positioned between the driving member and the actuator immediately following the driver. This leads to a very compact and operationally reliable construction of the selector with the particular feature that the travels of the co-operating elements are short.

In another embodiment, an actuating mechanism is disposed between the guide member and the actuator. This allows the use of actuators having reduced actuating forces, since the actuators are operative only to transfer the actuating information to the actuating mechanism but the locking and release of the driving member connected to the particular regulator concerned are effected by way of the actuating mechanism coupled with the loom drive.

In still another embodiment, a flexible connection may be used between the driving member and a yarn regulator. This enables the driving, locking and control and actuating elements co-operating with the driver to be arranged, within predetermined constructional limits. In a manner substantially independent of the operative arrangement of the yarn regulators. In particular, for example, adjustment of the loom to different cloth widths requires merely a corresponding adjustment of the yarn regulators while the driving members cooperating with the driver can remain in their position determined by the connection to the loom drive.

These and other objects and advantages of the invention will become more apparent from the following detailed description taken in conjunction with the accompanying drawings wherein:

FIG. 1 lllustrates a side view of parts of a weft yarn selector according to the invention with a yarn regulator in the standby position;

Figure 1:
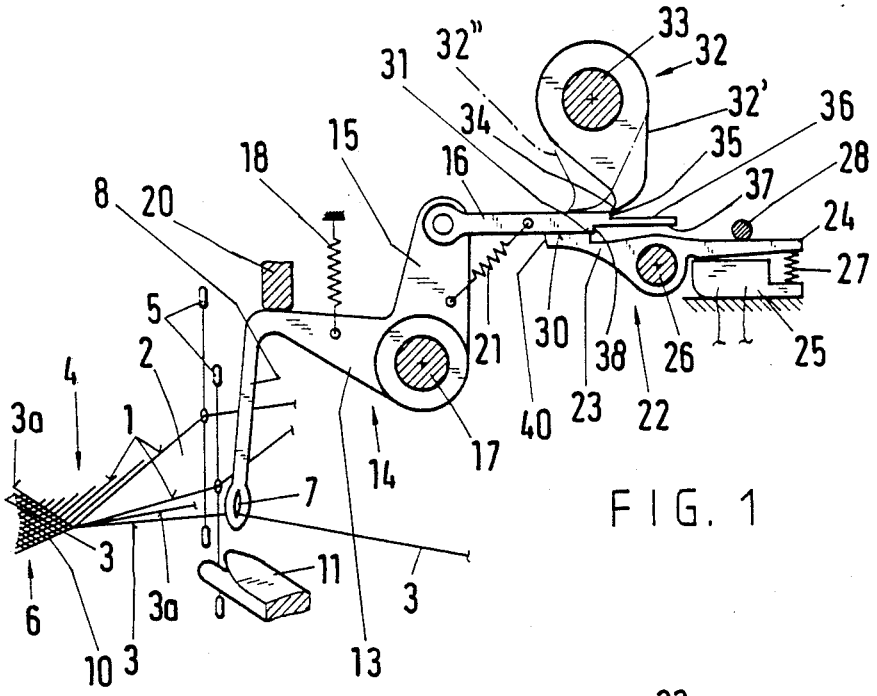
Figure 2:
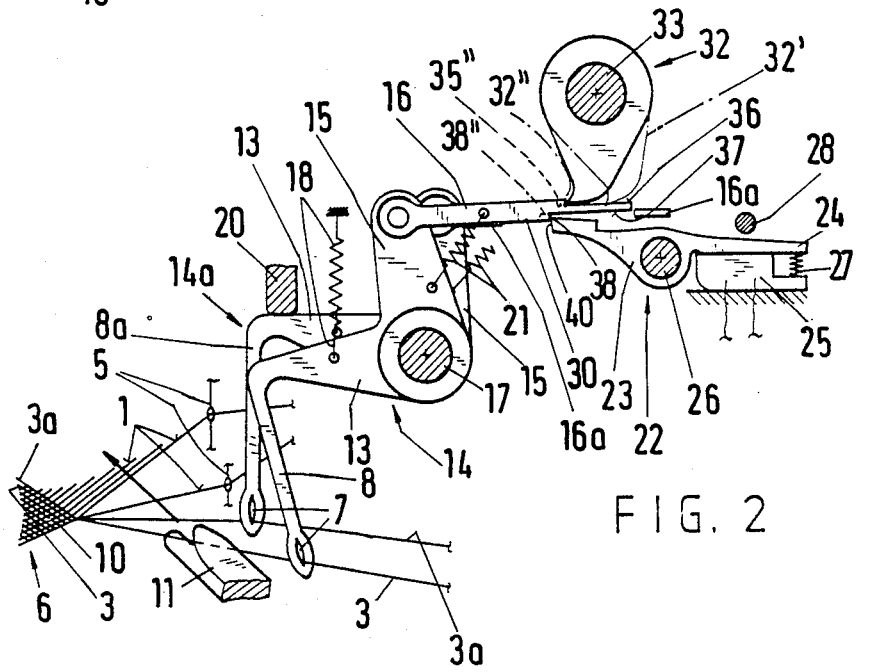
FIG. 2 illustrates the selector of FIG. 1 with a yarn regulator in the transfer position.

Referring to FIGS. 1 and 2, a plurality of warp yarns form a shed 2 to receive weft yarns 3, 3*a* for example in a gripper loom 4. The warp yarns 1 run off a warp beam (not shown) by way of shafts 5 to a cloth beam (not shown) which takes up the cloth 6 formed at the apex of the shed 2. A number of weft yarns 3, 3*a* for example of different colors are, in known manner, guided from weft packages (not shown) outside the shed 2 through guides 7 of associated rod-like yarn regulators 8, 8*a* respectively to the edge of the cloth 6. The regulators 8, 8*a* are parts of a weft yarn selector which is disposed on the picking side of the loom 4 and which can comprise a corresponding number for example, eight, of such regulators 8, 8*a*. Two such regulators are shown in FIG. 2. In a manner to be described hereinafter, each regulator offers or presents one of the weft yarns 3, 3*a* for a subsequent pick to a picking element which in the example shown is a gripper head 11 and which is introducible into the shed 2. The particular weft yarn 3, 3*a* concerned is picked into the shed 2 by the gripper head 11, which in known manner can be disposed, for example, on a flexible picking tape (not shown), and beaten up by a reed (not shown) onto the cloth 6 at the apex or tip of the shed 2.

Each regulator 8, 8*a* is formed on a first arm 13 of a two armed lever 14, 14*a* respectively embodied as shown as a bent lever; a second arm 15 of the lever 14 is pivotally connected to a driving member in the form a respective thrust rod 16, 16*a*. The levers 14, 14*a* of which only the lever 14 is shown in FIG. 1 can, as shown, be mounted one beside another in independently pivotable manner on a possibly common and non-displaceable shaft 17 disposed on the loom frame (not shown). Each lever 14, 14*a* is engageable, by the biasing of a return spring 18 secured to the loom frame, with a stationary abutment 20 extending over the arms 13 of all the levers 14, 14*a*. The abutment 20 retains the levers 14, 14*a* in their normal position shown in FIG. 1, in which position the corresponding regulator 8, 8*a* takes up a corresponding standby position such that the weft yarn 3, 3*a* has been pivoted out of the movement path of the gripper head 11.

The thrust rods 16, 16*a* of the yarn selector are each engageable, by a second return spring 21 secured to the second arm 15 of the respective lever 14, 14*a*, with a guide member which is in the form of a two-armed ratchet lever 22 having a first arm 23 engageable with the corresponding rod 16, 16*a* respectively and a second arm 24 engageable with a non-displaceable actuator, shown in the form of an electromagnet 25. FIGS. 1 and 2 show only the ratchet lever 22 which cooperates with the front thrust rod 16. The levers 22 can, as shown, be mounted for individual pivoting one beside another on a common shaft 26. Each lever 22 can bear by way of the arm 24—with biasing by the return spring 21 and a compression spring 27 disposed between the arm 24 and the electromagnet 25—on a common stop bar 28 which extends over all the arm 24 and which, with the associated electromagnet 25 in a passive state—i.e., currentless—retains the corresponding arm 24 at a reduced distance from the electromagnet 25.

With the ratchet lever 22 in the release position shown in FIG. 1, the rod 16 bears by way of a sliding surface 30 on a bearing part 31 of the lever arm 23. The rod 16 is retained in a normal position at a reduced distance below the movement path of a driver 32 of the selector secured to a shaft 33. In a manner which is not shown, for example, by way of a known cam arrangement, the shaft 33 is connected to the loom drive. By way of the shaft 33, the driver 32 is oscillated automatically at the cadence of the picking frequency between a rear end position 32', shown in solid lines in FIG. 1, and a front end position 32'' shown in chain-dotted lines. The driver 32 has a shoulder or step or the like 34 which extends transversely over all the rods 16, 16*a* and which is adapted to cooperate with corresponding companion steps 35 on each of the rods 16, 16*a*. The steps 35 are each contrived on a stepped or shouldered terminal part 36 of the thrust rod surface which is near the driver 32. The part 36 is so dimensioned that, when the associated electromagnet 25 is energized, the step 35 can move from the normal position of FIG. 1 before the shoulder 34 of the driver 32 in its rear end position 32' and can thus move into the movement path of the driver 32.

A second step 38 is contrived on an end part 37, which is stepped from the surface 30, of the thrust rod surface near the ratchet lever 22 and is adapted to cooperate with a locking part 40 devised at the end of the ratchet lever arm 23.

The electromagnets 25 are controlled, in dependence upon a control facility (not shown), in accordance with a predetermined weft yarn selection program. Upon energization of the electromagnet 25 associated with the rod 16, the ratchet lever arm 24 is attracted against the force of the spring 27, the arm 23 moving the rod 16 transversely, i.e., upwardly as viewed, and the step 35 engaging the shoulder 34 of the driver 32. The driver 32 then guides the rod 16 along the part 31 of the lever 22 from the normal position of FIG. 1 towards the operative position of FIG. 2 but the rod 16*a* is retained by the associated currentless electromagnet (not shown) in a normal position which is shown in FIG. 2 and which is outside the movement path of the driver 32. Correspondingly, the lever 14 with the yarn regulator 8 is pivoted against the force of the return spring 18 from the normal position of FIG. 1 into the transfer position of FIG. 2. The weft yarn 3 is thus offered to the gripper head 11 for the next pick. While the lever 14*a* remains in the normal position and the weft yarn 3*a*, like the other weft yarns (not shown), remains in the position outside the movement path of the head 11.

The position of the step 38 of each rod 16, 16*a* is such that, With the rod 16 in the operative position shown in FIG. 2, the step 38 is disposed before the end of the ratchet lever arm 23. Correspondingly, the return spring 21 engages the rod 16 by way of the stepped end part 37 on the end of the arm 23 and the rod 16 is moved, by the driver 32 which has moved into the front end position 32″, into a corresponding operating position in which the step 38 takes up a release position 38″ which is at a reduced distance from the locking part 40 and which permits an unhindered disengagement of the lever 22 from the part 37.

When the same weft yarn 3 is to be used for the next pick, the electromagnet 25 remains energized so that the lever 22 remains in the locking position shown in FIG. 2. Correspondingly, the rod 16, which the return spring 18 biases to follow the driver 32, is pressed by way of the step 38 on the locking part 40 of the lever 22 and remains in the operative position shown in FIG. 2. Correspondingly, the same weft yarn 3 is offered to the head 11 for the next pick, the driver 32 performing an idle stroke in the drive cycle corresponding to such next pick in moving from the rear end position 32′ towards the solid-line position of FIG. 2, the driver engaging with the step 35 only when in the latter position, the step 35 moving into a position 35″ corresponding to the front end position 32″ of the driver 32. If the same weft yarn 3 is also required for the next pick, the events described are repeated.

If a different weft yarn is required for the next pick, energization of the electromagnet 25 is interrupted after transfer of the weft yarn 3 to the head 11. The compression spring 27 then pivots the lever 22 back towards the release position of FIG. 1. Correspondingly, the rod 16, which the return spring 21 biases to follow the lever 22, is released by the driver 32. The driver 32 moves back to the rear end position 32′, and the rod 16 is returned by the return spring 18 along the part 31 of the lever 22 to the position shown in FIG. 1.

When the driver 32 has reached the rear end position 32′, one of the other thrust rods, for example, the rod 16*a*, is, in accordance with the predetermined weft yarn selection program, moved by the associated electromagnet into the path of the driver 32 and is moved thereby in the manner described into the front end position corresponding to the transfer position of the particular yarn regulator 8*a* concerned, the weft yarn 3*a* being offered to the head 11 for picking. The regulator 8*a*, and also the other yarn regulators (not shown), can, in accordance with the weft yarn selection program, be locked in the yarn transfer position by the associated ratchet lever 22 or released to return to the standby position.

The arrangement described obviates any crossing of the weft yarn moved from the standby position to the transfer position with the weft yarn which has returned to the standby position after the preceding pick, since the thrust rod corresponding to the first weft yarn to be picked can be moved into the path of the driver 32 only when the driver 32 takes up the rear end position 32′ and all the other thrust rods take up their normal positions correspondingly.

Referring to FIGS. 3 to 6, wherein like reference characters indicate like parts as above, the weft yarn selector may be constructed such that each ratchet lever 22 is connected to the associated electromagnet 25 by way of an actuating mechanism 43.

Figure 3:
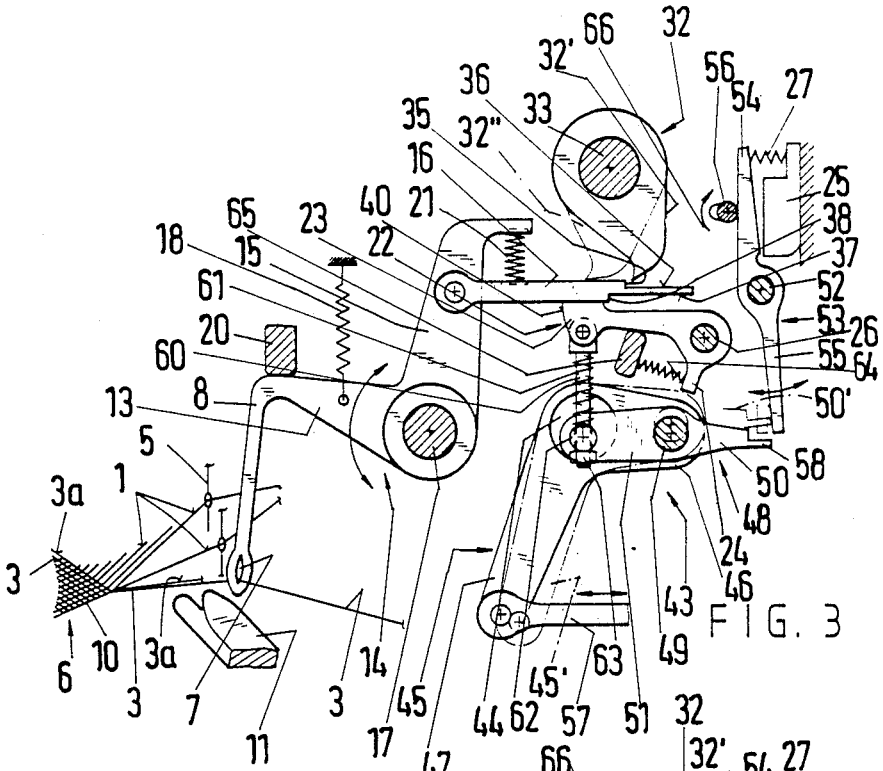
FIG. 3 illustrates a modified yarn selector according to the invention with an associated actuating mechanism and a yarn regulator in the standby position.

Referring to FIG. 3, the actuating mechanism 43 comprises a lever 45 which is pivotable by means of a non-displaceably mounted pin 44 and which has lever arms 46, 47, a number of sensing levers 48 associated one each with the levers 22 and having lever arms 50, 51, and a corresponding number of levers 53 disposed one each between one of the levers 22 and the associated electromagnet 25 and having lever arms 54, 55, and an actuating shaft 56 coupled with the loom drive.

Figure 4:
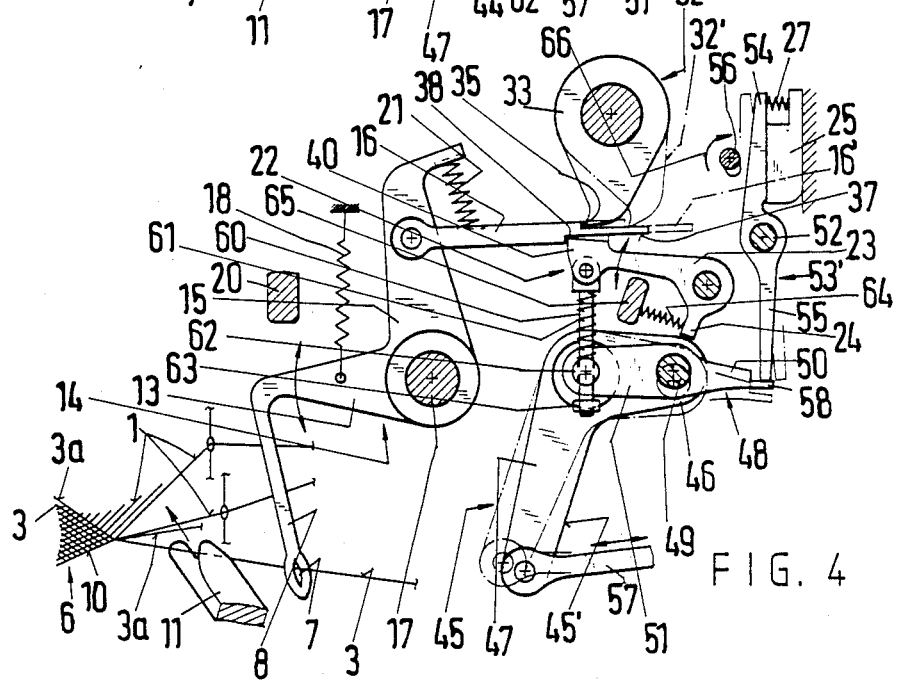
FIG. 4 illustrates the selector of FIG. 3 with the yarn regulator in the transfer position.

The levers 48 are mounted for independent pivoting on a common shaft 49 secured to the lever arm 46 of lever 45. Two corresponding levers 45 can be provided and interconnected by the shaft 49. The levers 53 are mounted for individual pivoting on a common non-displaceable shaft 52. The shaft 56, which is a cam shaft, co-operates with the lever arms 54, which are magnet armatures, of all the levers 53. Correspondingly, each of the levers 53 is movable at the picking frequency cadence between, on the one hand, a normal position which is shown in solid lines in FIGS. 3 and 6 and which is distant from the electromagnet 25 and from the pivoting path of the sensing lever arm 50 and, on the other hand, a locking position shown in solid lines in FIG. 5, in which position the lever arm 54 engages or at least moves close to the associated electromagnet 25 and the lever arm 25 extends into the pivoting path of the sensing lever arm 50. With the electromagnet 25 passive—i.e., currentless—the compression spring 27 returns the lever 53 from the locking position into the normal position shown in FIGS. 3 and 6. As shown in FIG. 4 with the electromagnet 25 active—i.e., energized—the lever 53 is retained in the locking position.

Figure 5:
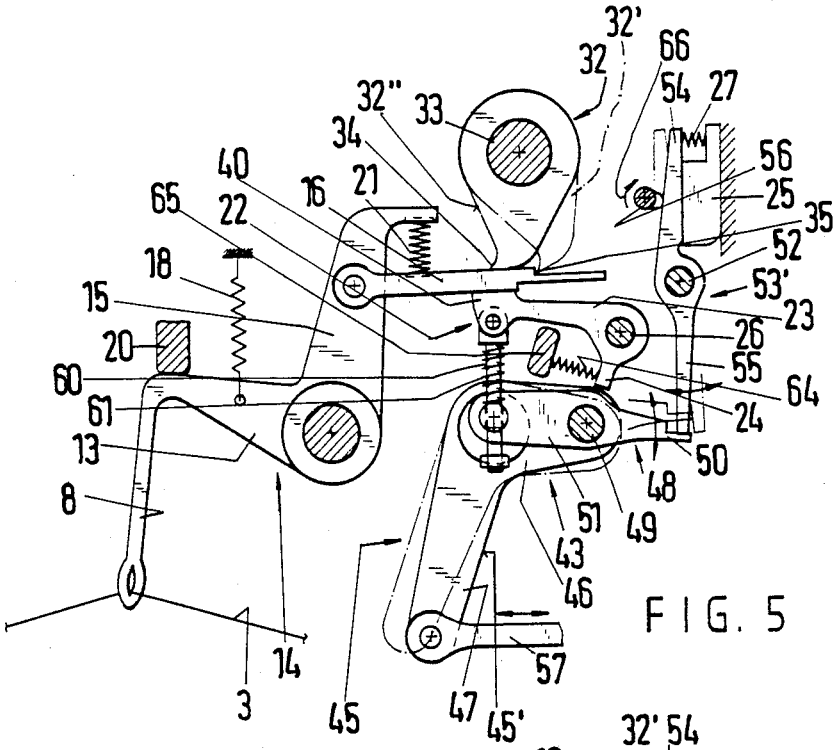
FIG. 5 illustrates the yarn selector of FIG. 3 in a standby position with the actuating mechanism in an operative position.
Figure 6:
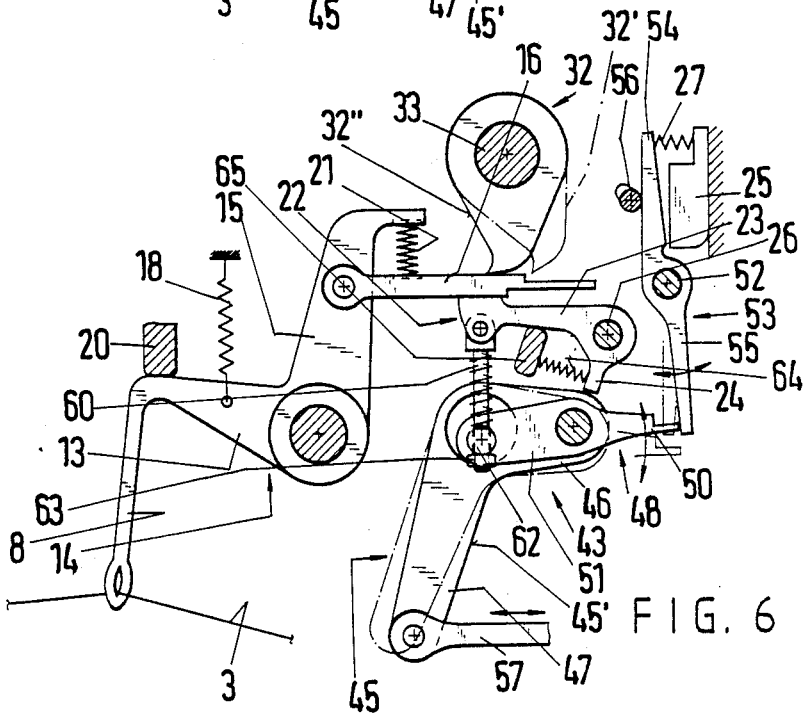
FIG. 6 illustrates the selector of FIG. 3 in the standby position with the actuating mechanism in another operative position.

A rod 57 pivoted to the arm 47 of the lever 45 connects the lever 45, for example, by way of a cam arrangement (not shown), to the loom drive and the lever 45 is oscillated automatically between a normal position, shown in solid lines in FIG. 3, and an operative position 45′ shown in chain-dotted lines FIG. 3 and in solid lines in FIGS. 4–6. The sensing levers 48 articulated to the lever 45 by way of the shaft 49 each have on one lever arm 50 an end part 58 engageable with the end of the lever arm 55 of the adjacent lever and are connected, in each case by way of a guide rod 60 movable on the other lever arm 51 and of a prestressed compression spring 61, to the associated ratchet lever 22 which, in the embodiment shown, is in the form of a bent lever. The guide rod has one end pivotally connected to the ratchet lever arm 23 while the other end is guided for movement along the longitudinal axis of the rod 60 in a slide block 62 rotatably mounted on the lever arm 51. As the drawings show, the compression spring 61 can extend around the rod 60 and bear at one end on a collar of the rod 60 and at the other end on the slide block 62. The normal position of the sensing lever 48, which is shown in solid lines in FIGS. 3 and 6 and which is removed from the locking lever 653 is determined by the position of a nut 63 disposed for adjustment on the free end of the rod 60, the compression spring 61 pressing the slide block 62 against the nut 63.

The ratchet lever arm 23, when in the position corresponding to the normal position of the rod 16 as shown in FIGS. 3 and 6, is pressed by a biassed compression spring 64 onto a bearing support 65 which extends over the arms 23 of all the levers 22. As shown, the compression spring 64 can be disposed between the support 65 and the second arm 24 of the ratchet lever 22.

FIG. 3 shown the thrust rod 16 and the levers 45, 48, 53 in their normal positions which they can take up at the end of a weaving cycle if the electromagnet 25 is in the deenergized state and if the cam shaft 52 is in the angular position shown and if the driver 32 is in its rear position 32'.

During each weaving cycle, the lever 45 is automatically moved by the rod 57 from the normal position of FIG. 3 into the operative position 45' of FIGS. 4–6, then back into the normal position of FIG. 3. The shaft 56 which is driven automatically as indicated by an arrow 66 simultaneously moves all the levers 53 from the normal position of FIG. 3 into the locking position 53' shown in FIGS. 4 and 5, in which position the lever 53 corresponding to the particular yarn regulator 8 selected is retained by the electromagnet 25 which has been energized in accordance with the predetermined selection program. The other levers 53 (not shown) on the same shaft 52 are disengaged from the associated and correspondingly currentless electromagnet 25 and returned to the normal position of FIG. 3. The lever 53 which the energized electromagnet 25 has retained in the locking position 53' extends by way of the arm 55 into the pivoting path of the lever arm 50 of the associated sensing lever 48 and therefore forms an abutment for end part 58. Correspondingly, as the lever 45 simultaneously pivots into the operative position 45', the lever 48 pivots clockwise in FIG. 3 around the shaft 49, the arm 51 pressing onto the arm 23. The slide block 62 then disengages from the nut 63 and the rod 16 is pressed from the normal position of FIG. 3 towards the driver 32 into the position 16' shown in chain-dotted lines in FIG. 4.

Referring to FIG. 4, the thrust rod step 35 is, in a manner already described, introduced before the driver 32 when in the rear end position 32', so that the rod 16 is then moved into the operative position, shown in solid lines in FIG. 4. The yarn regulator 8 is thus pivoted into the transfer position shown and the weft yarn 3 is offered to the gripper head 11 for picking. If the same weft yarn 3 is to be used for the next pick, the electromagnet 25 stays energized and, in a manner hereinbefore described, the rod 16 is retained in the operative position shown in FIG. 4 by the locking part 40 of the ratchet lever 22, the latter part engaging in the stepped end part 37. If a weft yarn other than the weft yarn 3 is required for the next pick, energization of the electromagnet 25 is interrupted so that the lever 48 is released, because the lever 53 pivots back correspondingly into the normal position. The compression spring 64 then disengages the ratchet lever 22 from the past 37 and the thrust rod 16 returned to the normal position shown in FIG. 3.

FIG. 5 shows the operative position of the selector in a weaving cycle in which a weft yarn other than the weft yarn 3 shown is required to be picked, so that the regulator 8 shown, together with the other unselected regulators (not shown), remains in standby position, the electromagnet 25 being currentless. As shown, the lever 53 is retained in the locking position 53'. This is determined merely by the shape and angular position of the shaft 56. In this position, the arm 55 of the lever 53 is operative as a stop for the arm 50 of the associated sensing lever 48 which, in a manner described and by way of the compression spring 61 and the ratchet lever arm 23, presses on the rod 16. The pattern and duration of the movement cycles of the driver 32, shaft 56 and lever 45 are so adapted to one another that the locking position 53' of the levers 53, such position being determined by the angular position of the shaft 56, is reached only when the step or shoulder 34 of the driver 32 has already moved beyond the position, associated with the normal position of the rod 16, of the step 35 engageable with the step 34. Correspondingly, the rod 16 is pressed on the driver 32 by the ratchet lever arm 23 but is not engaged with the driver 32.

Referring to FIG. 6 after a brief interval of time determined by the shape of cam of the shaft 56, the lever 53 is returned by the spring 27 to the normal position so that the lever 48 releases, the lever 22 returns towards the support 65 and the rod 16 moves away from the driver 32.

The cyclic movement of the lever arms 54 of all the levers 53 towards the associated electromagnets 25 enables magnets of reduced magnetic force to be used since the forces required to engage and disengage the co-operating elements of the selector can be provided substantially by the springs 61, 64.

Figure 7:
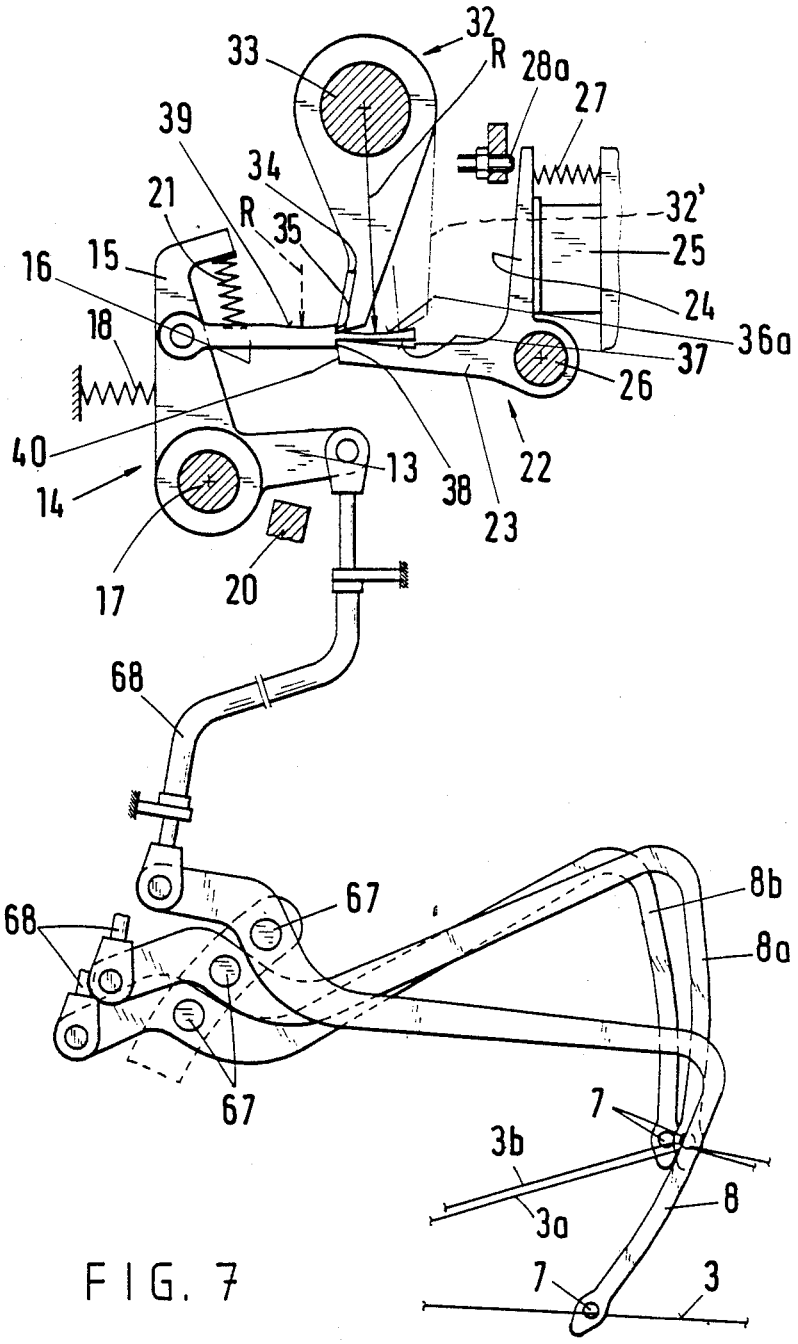
FIG. 7 illustrates a view of another modified weft yarn selector according to the invention.

Referring to FIG. 7, wherein like reference characters indicate like parts as above, the yarn selector may be constructed such that the regulators 8, 8*a*, 8*b* are each pivotally disposed on a shaft 67 and each coupled with the associated lever 14 by way of a flexible connection or transmission element such as a Bowden cable 68. The regulators 8, 8*a*, 8*b* are adjustable, within the constructional limits imposed by loom dimensions, independently of the arrangement of the driving elements—levers 14, rods 16 and drivers 13—cooperating with them. The arrangement of the regulators 8, 8*a*, 8*b* can therefore be shifted relative to the drive elements and arranged, for example, for different cloth widths of the loom.

As is also apparent from FIG. 7, the thrust rod surface opposite the driver 32 may have a concave end part 36*a* having a curvature of a radius R corresponding to the radius of the pivoting region of the driver 32. A concave surface part 39 adapted to such pivoting region can be provided in the central part of the length of the rod 16, the latter part following on from the step 35. Consequently, the rod 16 can be retained substantially stationary near the driver 32 or in engagement therewith both in the locked operative position of FIG. 7 and in the disengaged normal position, so that the engagement and disengagement of the rods 16 calls for correspondingly reduced travels of the ratchet lever 22. To limit the pivoting range of the levers 22, an adjusting screw 28*a* can, as shown, be associated with each lever arm 24.

Some of the contract surfaces of the steps 35, 38, 34 and part 40 and other correspondingly co-operating contact surfaces of the facilities described can each have a covering of a wear-resistant material, for example, hard metal or be formed on an insert made of such material.

Other equivalent activators, for example, pneumatic actuators can be provided instead of electromagnets 25. The selector is of use for looms having different picking means, for example, needles or rapiers, drag shittles or the like. A corresponding arrangement could conceivably be used for picking systems having fluid picking means.

The invention thus provides a weft yarn selector wherein a yarn regulator can be retained in a transfer position after a pick without having to re-cycle should the same yarn be required for the next pick.

The invention further provides a yarn selector in which unnecessary movements of the yarn regulators are obviated and stressings of the selector and weft yarns are reduced.

What is claimed is:

1. A weft yarn selector for a loom comprising a plurality of yarn regulators, each regulator being selectively movable between a standby position and a transfer position;

a plurality of driving members, each said member being connected with a respective regulator for moving said regulator between said positions and having a step therein;

a common driver oscillated at the cadence of a picking frequency for engaging against said step of a selected driving member to move a respective regulator between said positions;

a plurality of guide members, each said guide member being engageable with a respective driving member to position said respective driving member in engagement with said driver;

a plurality of electromagnets, each electromagnet being operable between an active state and a passive state and being positioned adjacent a respective guide member to move said respective guide member into engagement with a respective driving member in said active state; and each said guide member being engageable with a respective driving member in said active state of a respective electromagnet to position said respective driving member for engagement with said driver for movement therewith into a position corresponding to said yarn transfer position and to selectively lock said respective driving member in said position corresponding to said yarn transfer position and being disengaged from said respective driving member in said passive state to allow said respective driving member to move with said driver into a position corresponding to said yarn standby position.

2. A selector as set forth in claim 1 wherein each respective driving member has a second step engageable with a respective guide member in said locked position and wherein said respective guide element is movable transversely of said respective driving member.

3. A selector as set forth in claim 2 wherein each respective driving member is movable by said driver beyond said locked position into a position spacing said second step from said respective guide member.

4. A selector as set forth in claim 1 wherein said driver, said driving elements and said guide members have wear-resistant contact zones therebetween.

5. A selector as set forth in claim 1 wherein each guide member is a two-armed lever positioned between a respective electromagnet and a respective driving member.

6. A selector as set forth in claim 1 which further comprises an actuating mechanism between each respective electromagnet and a respective guide member for moving said respective guide member.

7. A selector as set forth in claim 6 wherein said mechanism includes an oscillating lever oscillated at the cadence of the picking frequency and a sensing lever articulated to said oscillating lever and having an abutment part engageable with a respective electromagnet, and a pressing member biased against a respective guide member in said active state of a respective electromagnet.

8. A selector as set forth in claim 1 wherein said respective driving member has a concave surface opposite said driver on a radius equal to the movement path of said driver.

9. A selector as set forth in claim 1 which further comprises a flexible connection between each driving member and a respective regulator.

10. A weft yarn selector for a loom comprising a yarn regulator for guiding a weft yarn and movable between a standby position and a transfer position;

a driving member for moving said yarn regulator between said positions, said member having two steps therein;

a driver engageable against one step of said driving member to move said regulator from said standby position into said transfer position;

a guide member for moving said driving member transversely of said driver to permit engagement of said driver with said one step, said guide member being engageable with a second step of said driving member to lock said regulator in said transfer position; and an actuator operable between an active state and a passive state, said actuator being connected with said guide member to move said guide member against said driving member in said active state to permit engagement of said driver with said one step and to permit engagement of said guide member with said second step.

11. A weft yarn selector as set forth in claim 10 which further comprises a first spring biasing said guide member away from said driving member in said passive state of said actuator and a second spring connected to said regulator for biasing said regulator into said standby position.

12. A selector as set forth in claim 10 wherein said guide member is a two-armed lever positioned between said driving member and said actuator.

13. A selector is set forth in claim 10 which further comprises an actuating mechanism between said guide member and said actuator.

14. A selector as set forth in claim 13 wherein said mechanism includes an oscillating lever oscillated at the cadence of the picking frequency and a sensing lever articulated to said oscillating lever and having an abutment part engageable with said actuator and a pressing member biased against said guide member in said active state of said actuator.

15. A selector as set forth in claim 14 which further comprises a pivoted lever between said actuator and said abutment part of said sensing lever, said pivoted lever being movable between a normal position spaced from said actuator and said sensing lever and a locking position engaging said actuator and in the path of said sensing lever, whereby with said pivoted lever in said locking position said pressing member is maintained against said guide member.

16. A selector as set forth in claim 10 wherein said driving member has a concave surface opposite said driver on a radius equal to the movement path of said driver.

17. A selector as set forth in claim 10 which further comprises a flexible connection between said driving member and said regulator.

18. A weft yarn selector for a loom comprising a plurality of yarn regulators, each regulator being selectively movable between a standby position and a transfer position;

a plurality of driving members, each said member being connected with a respective regulator for moving said regulator between said positions and having a first step and a second step therein;

a common driver oscillated at the cadence of a picking frequency for engaging against said first step of a selected driving member to move a respective regulator between said positions;

a plurality of guide members, each said guide member being engageable with a respective driving member to position said respective driving member in engagement with said driver;

a plurality of electromagnets, each electromagnet being operable between an active state and a passive state and being positioned adjacent a respective guide member to move said respective guide member into engagement with a respective driving member in said active state; and each said guide member being engageable with said second step of a respective driving member in said active state of a respective electromagnet to lock said respective driving member in a locked position corresponding to said yarn transfer position and being disengaged from said respective driving member in said passive state to allow said respective driving member to move with said driver into a position corresponding to said yarn standby position.

19. A selector as set forth in claim 18 wherein said respective guide element is movable transversely of said respective driving member.

20. A selector as set forth in claim 19 wherein each respective driving member is movable by said drive beyond said locked position into a position spacing said second step from said respective guide member.

* * * * *

UNITED STATES PATENT AND TRADEMARK OFFICE

CERTIFICATE OF CORRECTION

PATENT NO. : 4,852,618

DATED : August 1, 1989

INVENTOR(S) : HANS ZOLLINGER, et al.

It is certified that error appears in the above-identified patent and that said Letters Patent is hereby corrected as shown below:

On the title page, in the ABSTRACT, line 10, change "ever-arm" to --lever-arm--

Column 3, line 41, change "yarns" to --yarns 1--

Column 4, line 1, change "a" to --of a--

Column 7, line 13, change " shown" to --shows--

Column 7, line 63, change "past" to --part--

Column 8, line 63, change "contract" to --contact--

Column 12, line 23, change "drive" to --driver--

Signed and Sealed this

Third Day of March, 1992

*Attest:*

HARRY F. MANBECK, JR.

*Attesting Officer*

*Commissioner of Patents and Trademarks*